US006328676B1

(12) United States Patent
Alessandri

(10) Patent No.: US 6,328,676 B1
(45) Date of Patent: Dec. 11, 2001

(54) TREADMILL

(75) Inventor: Nerio Alessandri, Longiano (IT)

(73) Assignee: Technogym S.r.l., Gambettola (IT)

( * ) Notice: Subject to any disclaimer, the term of this patent is extended or adjusted under 35 U.S.C. 154(b) by 0 days.

(21) Appl. No.: 09/242,262

(22) PCT Filed: Jun. 15, 1998

(86) PCT No.: PCT/IB98/00930

§ 371 Date: Feb. 12, 1999

§ 102(e) Date: Feb. 12, 1999

(87) PCT Pub. No.: WO98/57711

PCT Pub. Date: Dec. 23, 1998

(30) Foreign Application Priority Data

Jun. 18, 1997 (IT) ..... B097A000372

(51) Int. Cl.[7] ..... A63B 22/02
(52) U.S. Cl. ..... 482/54
(58) Field of Search ..... 482/51, 54, 77, 482/52, 53; 198/841

(56) References Cited

U.S. PATENT DOCUMENTS 4,958,832 * 9/1990 Kim ..... 482/57
5,279,528 * 1/1994 Dalebout et al. ..... 482/54
5,336,146 8/1994 Piaget et al. .
5,441,468 8/1995 Deckers et al. .
5,476,430 12/1995 Lee et al. .
6,013,011 * 1/2000 Moore et al. ..... 482/54

FOREIGN PATENT DOCUMENTS 40 03 871 8/1991 (DE) .
92/11905 7/1992 (WO) .
97/21471 6/1997 (WO) .

OTHER PUBLICATIONS

Soviet Inventions Illustrated Section PQ, Week 8821 Derwent Publications Ltd., London GB; Class P36, AN 88–146032 XP002080090 & SU 1 347 953 A (Agashin F K) Oct. 30, 1987 see abstract.

* cited by examiner

*Primary Examiner*—Stephen R. Crow
(74) *Attorney, Agent, or Firm*—Arent Fox Kintner Plotkin & Kahn, PLLC

(57) ABSTRACT

The present invention relates to a treadmill (1) in which the running board (2) may be attached at the rear, while the portion designed for the actual performance of the exercise is cushioned by resilient elements (33) that may have an undulating surface positioned substantially perpendicular to the direction of cushioning; moreover, the present invention allows the treadmill (1) to respond to the force created following the impact of the user's feet with various values, according to the change in the resistance offered by the cushioning means (3; 3'; 3").

2 Claims, 2 Drawing Sheets

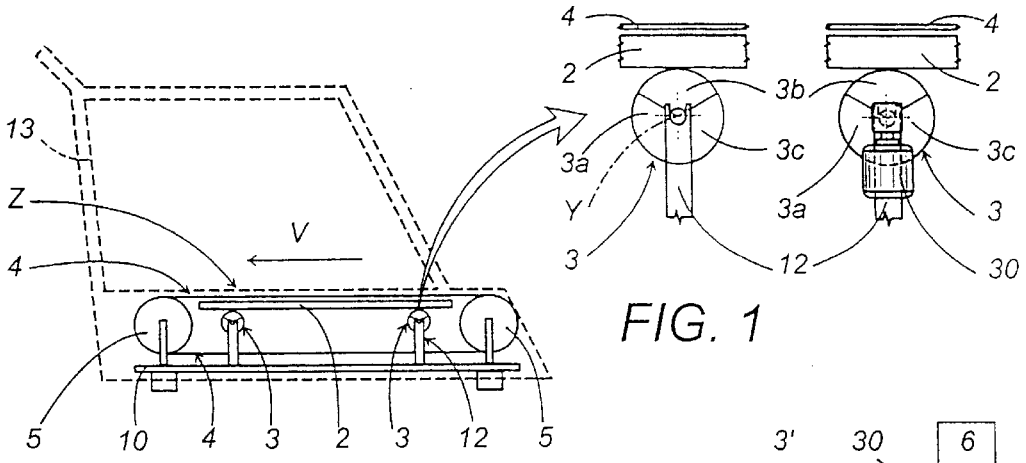
FIG. 1
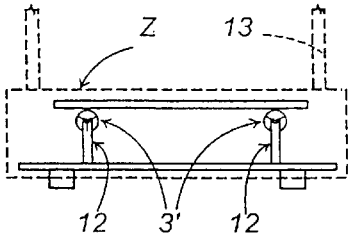
FIG. 2
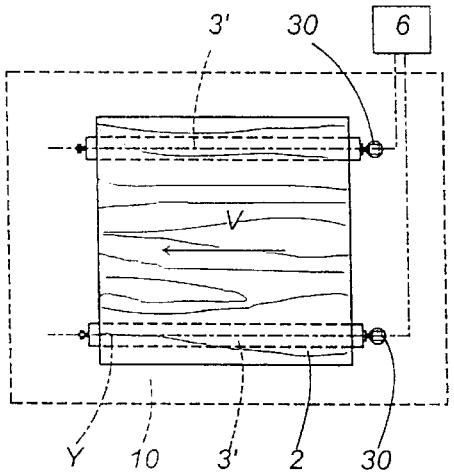
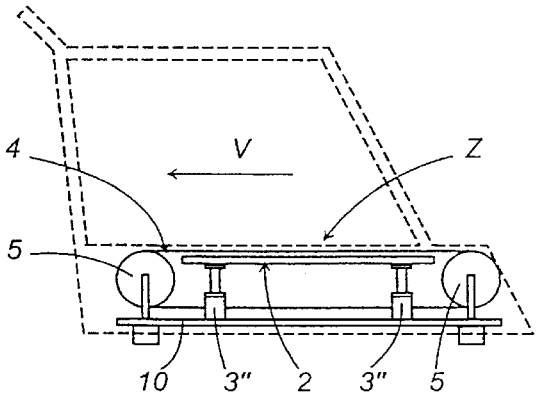
FIG. 3
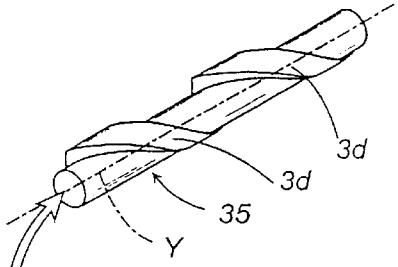
FIG. 5
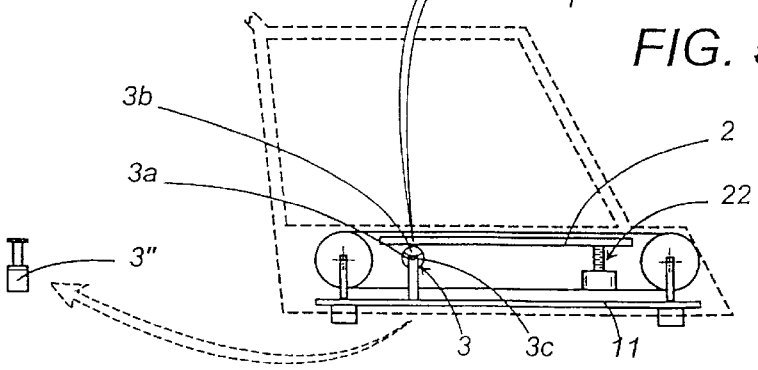

TREADMILL

TECHNICAL FIELD

The present invention relates to a treadmill which can be used in particular for exercise or rehabilitation.

BACKGROUND ART

In the exercise and rehabilitation equipment sector, machines designed to allow the user to perform aerobic exercises which "simulate" given sports or physical activities have become increasingly important, both for muscular training and for improving cardiovascular condition and general physical well-being.

For example, there are stationary machines that allow the user to perform exercises substantially comparable to riding a bicycle, climbing stairs or walking or running. The present invention relates to a treadmill, designed to allow the user to walk or run on the spot.

Machines of the afore-mentioned type use various types of devices in an attempt to recreate as faithfully as possible the actual reaction of the means with which the human body interacts, so that the exercise performed in the gym is as similar as possible to that of the activity in question. In simulating physical activity, especially in modern machines, every effort has been made to emphasise the positive aspects of the exercise and limit any disadvantages, so that the training or rehabilitation results in the user obtaining the benefits of the specific exercise, as far as possible limiting any negative characteristics involved in performing the exercise.

In the case of the example relative to the present invention, the athletic movement involved in walking and running is simulated thanks to the presence of a belt moved on pulleys and which moves in the opposite direction to that which would be followed by the treadmill user when actually performing the corresponding exercise.

One of the main disadvantages of walking and, to a greater degree, running is the shock to the body of the walker or runner caused by the reaction of the ground under foot; in other words, especially on hard surfaces, the reaction of the ground can negatively influence the exercise and in some cases causes tendon, joint and other types of pathologies.

The above-mentioned disadvantage is also encountered on treadmills of the known type. In such machines, at least in the zone designed for performance of the exercise (that is to say, the zone on which the user walks or runs) there is a board that supports the belt when a force is exerted on the latter by the user.

Given that they must support the belt, the boards normally used are made of rigid material. For this reason, when, during exercise, the user exerts a force on the belt-board assembly, the corresponding reactions may prove damaging since they are insufficiently cushioned.

In order to limit any negative effects, technical development in the exercise machine sector has contributed to the application of modifications to the board zone, attempting to dampen the reaction of the belt to the force exerted by the user.

Document U.S. Pat. No. 3,689,066 describes a treadmill in which a set of hollow elements with variable volume and with valves designed to define a sort of air cushion is applied to the board. When used, the force exerted on the board by the user and the consequent response are dampened thanks to this air cushion.

Document U.S. Pat. No. 5,454,772 describes treadmills in which resilient elastomer elements are envisaged between the base and the belt supporting board.

The reaction of the treadmill is proportional to a constant, invariable value. This means that it is impossible to vary the treadmill's response according to the type of exercise to be performed, substantially obtaining responses that are always the same for equal forces exerted.

This is a disadvantage since, with elements that have a "fixed" reaction, meaning that it is impossible to vary the elastic constant relative to the treadmill's response, it is impossible to set exercises according to important parameters, such as those listed below. These parameters, which may vary greatly, may comprise the user's physique, gait, pronation, degree of fitness, the effects of having warmed up, any problems linked to pathologies, etc.

Another attempt to overcome this disadvantage is that proposed in U.S. Pat. No. 4,350,336, which describes a treadmill with a supporting board hinged at one end of the treadmill structure, and a cushioning support, comprising rubber blocks and positioned beneath the board; the support may be moved lengthways under the board so as to vary the leverage value defined by the hinged board and, as a result, the value of the contribution of the force exerted by the user. In other words, there is a sort of trampoline resting on a wedge defined by the cushioning support with fixed elastic constant and, in an attempt to obtain a different response to the action of the user, the contribution of the action itself is varied rather than the elastic reaction of the support; thus, with reference to the lever formed by the trampoline, the point in which the resistance is exerted (elastic reaction of the support) is moved, without changing the type of resistance offered.

The technical sector for treadmills is overcrowded with a large number of technical solutions for specific aims and/or the production of details.

DISCLOSURE OF THE INVENTION

The aim of the present invention is, on one hand, to overcome the above-mentioned disadvantages and, on the other hand, to propose new solutions, not comparable to technical problems relative to the prior art.

The present invention proposes a treadmill in which the running board may be attached at the rear, whilst the portion designed for performance of the exercise is cushioned by resilient elements that may have an undulating surface, positioned substantially perpendicular to the direction of cushioning and which are extremely advantageous, that is to say, extremely functional, from a kinematic viewpoint.

Moreover, the present invention allows the treadmill to respond to the force created following the impact of the user's feet with a response having various values, according to the change in the resistance offered by the cushioning means.

These cushioning means, which may be of different shapes and be positioned in different zones between the board and the treadmill supporting structure, have the distinctive characteristic of providing different responses to the action of the user thanks to a variation in the intrinsic reaction to the said cushioning means. In other words, the variation in the reaction to the forces exerted on the treadmill is not determined by moving the cushioning means, but by a variation in their type of response to the stresses applied.

The technical characteristics of the present invention according to the above-mentioned aims are clearly illustrated in the claims herein and its advantages are clearly shown in the description below, with reference to the accompanying drawings, which show a preferred embodiment and in which:

FIG. 1 is a schematic side view of an embodiment of the present invention, with details not to scale;

FIG. 2 is a schematic rear view and top plan view of another embodiment of the present invention, with some parts cut away and with details not to scale;

FIG. 3 is a schematic side view of another embodiment of the present invention, with details not to scale;

FIG. 5 is a schematic side view of another embodiment of the present invention, with details not to scale;

Figure 4:
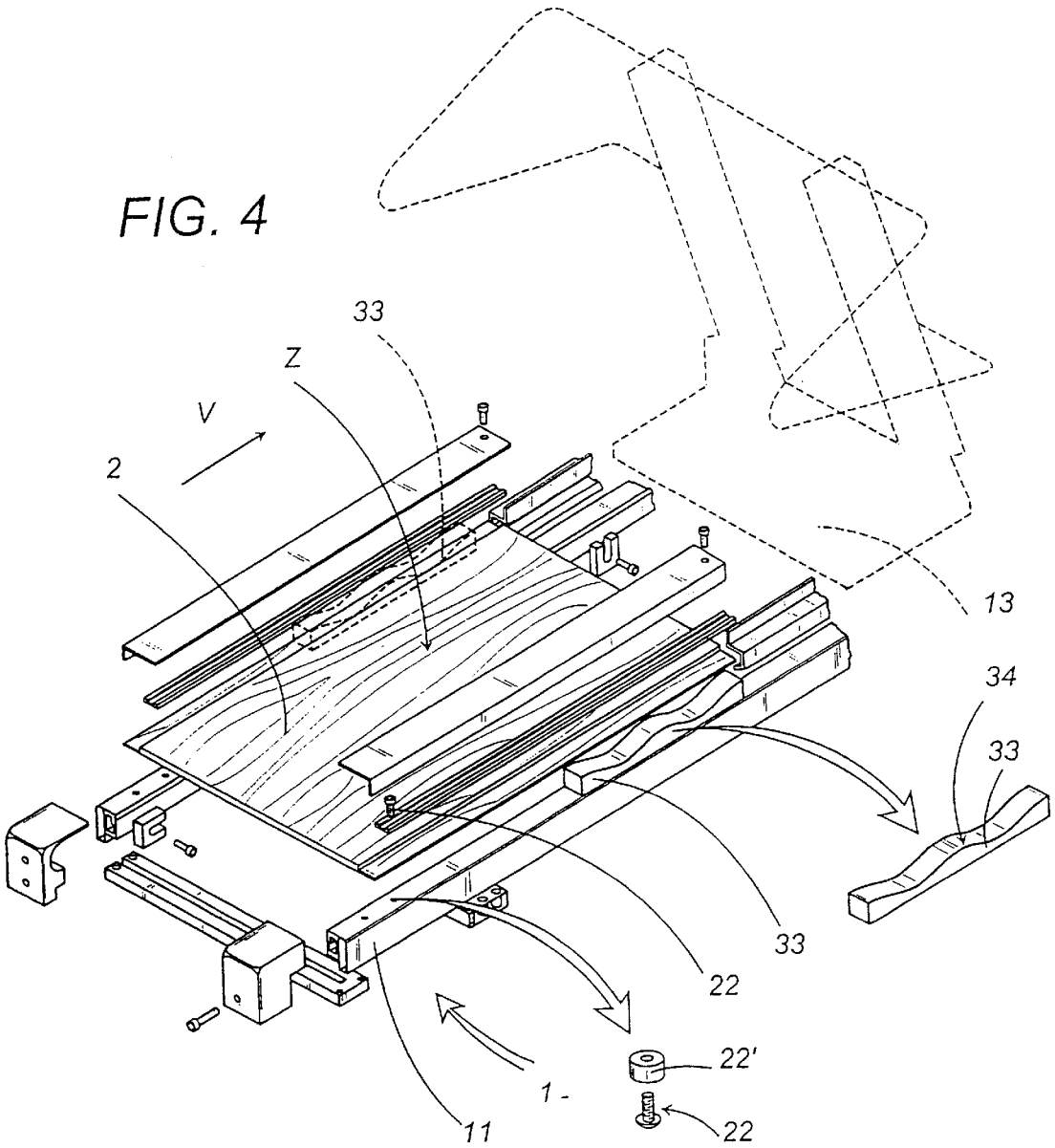
FIG. 4 is a schematic top perspective view of another embodiment of the present invention, with some parts cut away and details not to scale.

As indicated in the previous section of the present description, a treadmill made according to the present invention is of the type that may be used for exercise or rehabilitation.

The numeral 1 is used to label the treadmill as a whole, whilst the numeral 13 is used to label some of the parts (illustrated with a dashed line), such as the treadmill housing, console and handrails, which are not part of the present invention.

The base 10 of the treadmill 1 is designed to support a belt 4 operated by drive means (for the purpose of clarity represented by the two pulleys 5 in FIGS. 1, 3 and 5 and not illustrated in the remaining figures), designed to drive the belt along a closed loop path.

Above this, along the path of the belt 4, is a zone Z for the performance of an exercise. In this zone Z the belt moves at a speed V and in a direction determined according to the exercise to be performed.

On the base 10, below the zone Z for performance of an exercise, is a board 2 that supports the user on the belt 4. In other words, the board supports the user during the exercise.

In particular, with reference to the example in FIG. 4, the treadmill 1 may have means which lock the board to the base 10 of the treadmill, said locking means located at the rear of the board 2.

At least two fixing elements 22 may be envisaged, for example, screws 22 attached to rigid bushings 22', operating perpendicular to the board 2.

At another zone of the board, that is to say, in the zone Z for performance of the exercise, the embodiment illustrated in FIG. 4 has cushioning means comprising at least two resilient elements 33, which extend lengthways, at the crossbars 11 on the lower section of the base 10.

The resilient elements 33 are positioned parallel with the crossbars 11 and act upon the board at its lateral edges.

As illustrated in the right-hand detail in FIG. 4, the resilient elements 33 may have an undulating surface 34 positioned substantially perpendicular to the direction of compression-cushioning; for example, the undulation may be envisaged on the upper surface 34, facing the board 2.

This special "wave" shape of the resilient elements is particularly effective for the graduality offered in the reaction to the force exerted by the user.

Figure 6:
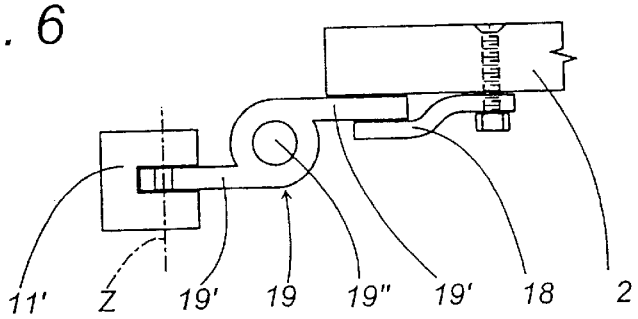
FIG. 6 is a schematic partial side view of a detail of a possible embodiment of the invention disclosed.

As shown in the example illustrated in FIG. 6, the treadmill 1 may also envisage suitable elastic connecting means 19 between the board and the base 10. These means may comprise a connecting element 19 made of a material which yields elastically, or shaped in such a way that said yielding action is obtained, having a substantially "S"-shaped cross-section. The two tabs 19' which constitute the two opposite ends of the element 19 are attached to each of the crossbars 11 and to a relative longitudinal edge of the board 2. The tabs 19' may be fixed on the board and crossbars directly, or indirectly, for example on the board 2 side, by means of a sheet metal element which, when screwed onto the lower portion of the board 2 clamps the corresponding tab 19', fixing it to the board. Attachment of the crossbar 11 in FIG. 6 is illustrated schematically with a symbolic portion 11' of the crossbar itself and a vertical axis Z designed to define the position of a relative rod-shaped fixing part, not illustrated.

In order to improve the response to stresses, the connecting element 19 may have a hole 19" that extends lengthways in its central portion.

As illustrated in the FIGS. 1, 2, 3 and 5, the board 2 on the treadmill 1 disclosed may have the advantage of being equipped with variable-reaction cushioning means, designed to allow a variation in the reaction of the treadmill 1 to the activities of the user.

These cushioning means may be made in various ways, and the accompanying drawings illustrate several examples.

With reference to the examples in FIGS. 1 and 2, the variable-reaction cushioning means may comprise a set of at least two resilient elements with different elastic constants, which can be attached separately to the board 2 according to the desired reaction force.

In particular, the resilient elements may be supported by a drum or a roller which turns about an axis of rotation Y, or they may form the drum itself. In the examples, there are 3 resilient elements labelled 3*a*, 3*b* and 3*c*, separated by given angles from the axis of rotation Y, in such a way as to pass from the use of one to another by rotation of said rotary drum. The three resilient elements may be made of elastomers with different elastic constants in reaction to the mechanical stress.

Again with reference to the examples, the resilient elements may be supported by or may comprise two (or more) rotary drums. Each rotary drum is supported by relative supporting means 12 integral with the base 10; these supporting means may comprise, for example, brackets 12 that support pins upon which the rotary drums turn. The drums may be turned manually or may be driven by drive means 30, designed to turn the drums (about axis Y), in such a way as to change the resilient element that interacts with the board 2 and, as a result, change the reaction offered by the treadmill.

The rotary drums may be positioned across the direction of feed V of the belt 4, as illustrated in the example in FIG. 1, or parallel with said direction, as illustrated in FIG. 2.

In the example in FIG. 3, the cushioning means 3" comprise at least a hydraulic or pneumatic cylinder with variable compressibility, obviously connected to and controlled by a control panel by means of a suitable circuit (the control panel and circuit are not illustrated). In this case, the different reaction to the action of the user that can be provided by the treadmill may be obtained by a fluid variation within the cylinders 3'.

In the example illustrated, two cylinders 3" are envisaged below the board 2 and directly supported by the base 10.

The rotary drums previously indicated may also have similar automatic programming, by connecting suitable processing means 6 to the drive means 30, as illustrated in the schematic example in FIG. 2.

Using dedicated software programs, it will, therefore, be possible to make the reaction offered by the treadmill similar to that of the most suitable surface for the exercise to be performed, thus improving the positive effects of the training and/or rehabilitation.

FIG. 5 is a schematic illustration of another embodiment of the treadmill disclosed.

This embodiment envisages the coupling of the fixing means 22 which attach the rear portion of the board 2, to cushioning means of the type described relative to the examples illustrated in the FIGS. 1 to 3.

In fact, a drum 3 equipped with the above-mentioned differentiated-reaction resilient elements may be envisaged, or a cylinder 31", or a further drum 35, illustrated in the right-hand detail. In this case, the resilient elements 3*d* comprise substantially wedge-shaped portions of the drum 35 which rotates about the axis of rotation Y. As the drum rotates about the axis, the wedge-shaped portions 3*d* allow the positioning between the board and base of different thicknesses of resilient element, with consequent different reactions to the stresses applied.

The invention described can be subject to modifications and variations without thereby departing from the scope of the inventive concept. Moreover, all the details of the invention may be substituted by technically equivalent elements.

What is claimed is:

1. A treadmill for use by a user for at least one of exercise and rehabilitation, comprising:

a base;

a movable belt forming a closed loop path, the belt being supported above the base, wherein the movable belt has an upper surface upon which the user performs at least one of exercise and rehabilitation;

a drive assembly for driving the belt;

a pair of parallel crossbars;

a support member located beneath at least a portion of the movable belt for supporting the user, wherein the support member extends substantially parallel to the pair of parallel crossbars;

a mounting assembly for locking a rear end of the support member to the pair of parallel crossbars, wherein the mounting assembly includes at least two fixing elements acting perpendicular to the support member; and a cushioning assembly for cushioning the support member, the cushioning assembly including at least two resilient elements located on the pair of parallel crossbars, wherein the resilient elements are located adjacent a front end of the support member and act upon lateral edges of the support member, wherein each of the resilient elements has an undulating surface positioned substantially perpendicular to the direction of compression-cushioning.

2. A treadmill for use by a user for at least one of exercise and rehabilitation, comprising:

a base;

a movable belt forming a closed loop path, the belt being supported above the base, wherein the movable belt has an upper surface upon which the user performs at least one of exercise and rehabilitation;

a drive assembly for driving the belt;

a pair of parallel crossbars;

a support member located beneath at least a portion of the movable belt for supporting the user, wherein the support member extends substantially parallel to the pair of parallel crossbars;

a mounting assembly for locking a rear end of the support member to the pair of parallel crossbars, wherein the mounting assembly includes at least two fixing elements acting perpendicular to the support member; and a cushioning assembly for cushioning the support member, the cushioning assembly including at least two resilient elements located on the pair of parallel crossbars, wherein the resilient elements are located adjacent a front end of the support member and act upon lateral edges of the support member, wherein each of the resilient elements has an undulating upper surface, wherein the surface faces the board.

* * * * *